United States Patent [19]

Doi et al.

[11] Patent Number: 4,982,816

[45] Date of Patent: Jan. 8, 1991

[54] SPEED CONTROL SYSTEM FOR ELEVATORS

[75] Inventors: Kazuhiko Doi, Narita; Yasutami Kito, Tokyo, both of Japan

[73] Assignee: Otis Elevator Company, Farmington, Conn.

[21] Appl. No.: 339,737

[22] Filed: Apr. 18, 1989

[30] Foreign Application Priority Data

Apr. 18, 1988 [JP] Japan ..... 63-94898

[51] Int. Cl.[5] ..... B66B 1/30

[52] U.S. Cl. ..... 187/119; 318/803

[58] Field of Search ..... 187/119; 318/807, 799, 318/800, 803

[56] References Cited

U.S. PATENT DOCUMENTS 4,330,741 5/1982 Nagase et al. ..... 318/803
4,366,427 12/1982 Walker et al. ..... 318/803 X
4,483,419 11/1984 Salihi et al. ..... 187/119
4,600,088 7/1986 Yonemoto ..... 187/119
4,602,701 7/1986 Tanahashi ..... 187/119
4,625,834 12/1986 Tanahashi ..... 187/119
4,677,361 6/1987 Yonemoto ..... 187/119 X

*Primary Examiner*—A. D. Pellinen
*Assistant Examiner*—W. E. Duncanson, Jr.
*Attorney, Agent, or Firm*—Francis J. Maguire, Jr.

[57] ABSTRACT

In an elevator provided with an inverter driven induction motor, output torque is determined by direct current of an inverter, slip frequency is determined from the thusly determined torque, the gap between an open-loop dictated speed pattern and the actual speed is compensated by the slip calculated during acceleration and constant speed movement, so that the open-loop control may be improved in terms of stop position precision.

3 Claims, 1 Drawing Sheet

SPEED CONTROL SYSTEM FOR ELEVATORS

TECHNICAL FIELD

This invention relates to a speed control system for inverter driven elevators, and more particularly to an open-loop speed control system.

BACKGROUND ART

An elevator nowadays employs an induction motor as a motor, and in many cases the induction motor is driven by an inverter which can produce variable voltage and variable frequency (VVVF). In an elevator drive apparatus including such an induction motor and an inverter in combination, the speed control of the induction motor is generally an open-loop control by an voltage inverter for low speed elevators while for medium and high speed elevators a speed feedback control with a speed detection device is utilized.

In the open-loop speed control, the acceleration, constant speed, and deceleration corresponding to a speed pattern are realized by controlling the output frequency of the inverter and further the output voltage thereof based on the speed pattern.

The conventional open-loop speed control has an advantage that the speed detector is not required, resulting in low cost and no need for back-up means for a speed detector failure. However, since there is not speed detection means for motor speed, i.e., passenger cage speed, and for hoisting distance, precision in stopping is likely deteriorated by load fluctuation.

DISCLOSURE OF INVENTION

An object of this invention is to provide a speed control system for improving the precision in stopping.

Another object is to improve the precision of an open-loop speed control in achieving a dictated speed pattern.

According to the present invention, in an elevator provided with an inverter driven induction motor, output torque is determined by measuring the direct current input to the inverter and relating that measurement to output torque, determining slip frequency from the thusly determined output torque and compensating the gap between a dictated speed pattern and the actual speed by the slip calculated during acceleration and again during constant speed movement, so that an open-loop control may be generally improved and also specifically, in terms of stop position precision.

In further accord with the present invention, a speed control system for an elevator employing an inverter for driving an induction motor is characterized in that it comprises a slip operation circuit for obtaining a slip frequency of the motor by measuring the direct current input to an inverter main circuit and a control device responsive to a dictated speed profile signal for obtaining output torque and load torque of the motor from said slip frequency signal and for calculating the rotating speed of the motor so that said control device may perform an inverter frequency and voltage control so as to make the actual speed pattern identical to the dictated speed pattern by an increased control of the slip frequency corresponding to the load torque during the acceleration and the constant speed movement and at the deceleration starting position the control device may perform an inverter frequency and voltage control so as to make the actual speed pattern identical to the speed pattern by an addition control of the slip frequency corresponding to said load torque.

A torque current is obtained from the direct current into the inverter, and from the torque current the slip frequency is obtained. Then, a motor output torque and a load torque are obtained by the ratio of the slip frequency and the rotating speed, and the required inverter frequency and the voltage are acquired. During acceleration and constant speed operation, a compensation corresponding to a gap between the speed pattern and the rotating speed is determined according to the above procedure while during deceleration the inverter frequency and voltage required for deceleration control corresponding to the speed pattern are produced.

As explained above, according to the present invention, since the slip frequency is obtained from the direct current of the inverter, and the load torque and the frequency and the voltage of the inverter are obtained, the control is performed the same as dictated by the speed pattern by the increased control based on torque corresponding to the load torque during acceleration and constant speed control while the required inverter frequency/voltage are computed during deceleration, the precise stopping control and the acceleration/deceleration being practically equivalent to the feed-back control without the need for a speed detector.

These and other objects, features and advantages of the present invention will become more apparent in light of the following detailed description of an exemplary embodiment thereof.

BEST MODE FOR CARRYING OUT THE INVENTION

Figure 1:
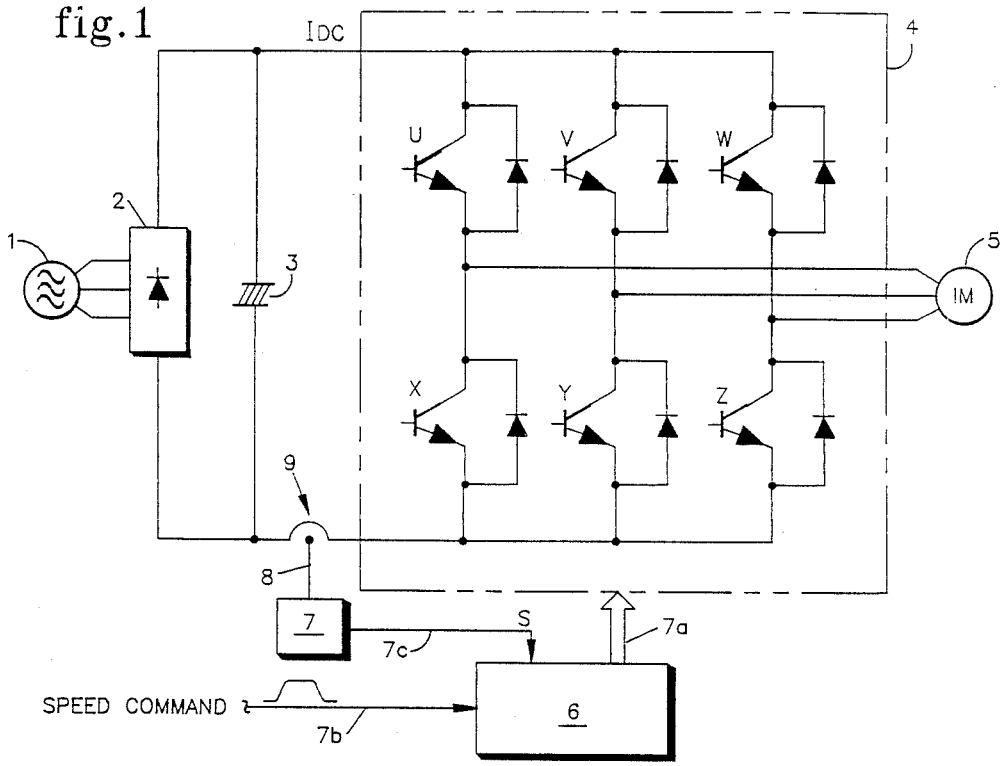
FIG. 1 is a block diagram showing an embodiment of this invention.

FIG. 1 is a block diagram showing an embodiment of the present invention. An alternating current source 1 is converted to the DC electric power by a rectifier 2, and smoothed by a capacitor 3. This DC electric power is inverted by a voltage-type inverter main circuit 4 to AC electric power with its frequency and voltage regulated, and supplied to an induction motor 5 which serves as a motor for an elevator. The regulation of the frequency and voltage in the inverter main circuit 4 is performed with a signal on a line *7a* from a regulator device 6. The signal on line *7a* controls the speed of the motor 5 by the method of pulse width regulation.

A speed command signal on a line *7b* is provided to the regulator device 6 and may have the character of a speed pattern having predetermined periods of acceleration and deceleration separated by a period of constant speed depending on traveling distance. The regulator device 6 determines necessary inverter frequency and voltage from the speed command and determines the magnitude of a slip frequency signal (S) on a line *7c* by means of a the operation of a circuit 7. Circuit 7 is responsive to a sensed DC current signal on a line 8 which is provided from a current sensor 9.

In the above-described system, the direct current $I_{DC}$ of the inverter main circuit 4 has a proportional relationship with the torque current $I_T$ as follows:

$$I_{DC}=(I_B+I_T)K \qquad 1$$

$I_B$: Current equivalent to excitation loss

K: Constant determined by ratio of AC voltage and DC voltage

Strictly speaking, a perfect proportional relation does not exist because of changes in the speed of the motor, changing of the primary current, and the like although, results using this proportional relation is practically acceptable.

From the relationship of the above equation (1), the slip operation circuit 7 calculates the torque current $I_T$ from the measured valued of direct current $I_{DC}$ (current detected by sensor 9 may be used also for overcurrent detection and the like).

Furthermore, the regulator device 6 computers the motor output torque $T_M$ from the slip S, and from the output torque $T_M$ the load torque $T_L$ is calculated by the following equation:

$$T_L = T_M - Tacc \quad (2)$$

where Tacc = acceleration torque determined by the polar moment of inertia ($Wk^2$) and the acceleration pattern.

And, the inverter frequency $F_M$ and voltage $V_M$ having slip S necessary to the load torque $T_L$ are computed by the following equations.

$$F_M = FR\{(N_M/N_R)+S\} \quad (3)$$

$$V_M = V_R N_M/N_R + SV_Z \quad (4)$$

where, $F_R$ = Motor rated frequency, $N_R$ = Motor rated rotating speed, $V_R$ = Motor rated voltage, and $V_Z$ = Impedance voltage drop at frequency $F_M$.

In setting the frequency $F_M$ and the voltage $V_Z$, the regulator means 6 performs an increased control with respect to time with the addition of slip S. Now, this will be explained in depth.

First, in the medium and low speed elevators, the speed pattern for acceleration and deceleration is fixed, operation repeating this speed pattern and the constant speed (depending on designated floor) is conducted, and the deceleration point (deceleration distance) for the designated floor is fixed. Therefore, the stop position of the passenger cage can be precisely controlled by decelerating with the same speed curve, namely with the same deceleration starting point and the same deceleration from the same speed, irrespective of load.

Figure 2:
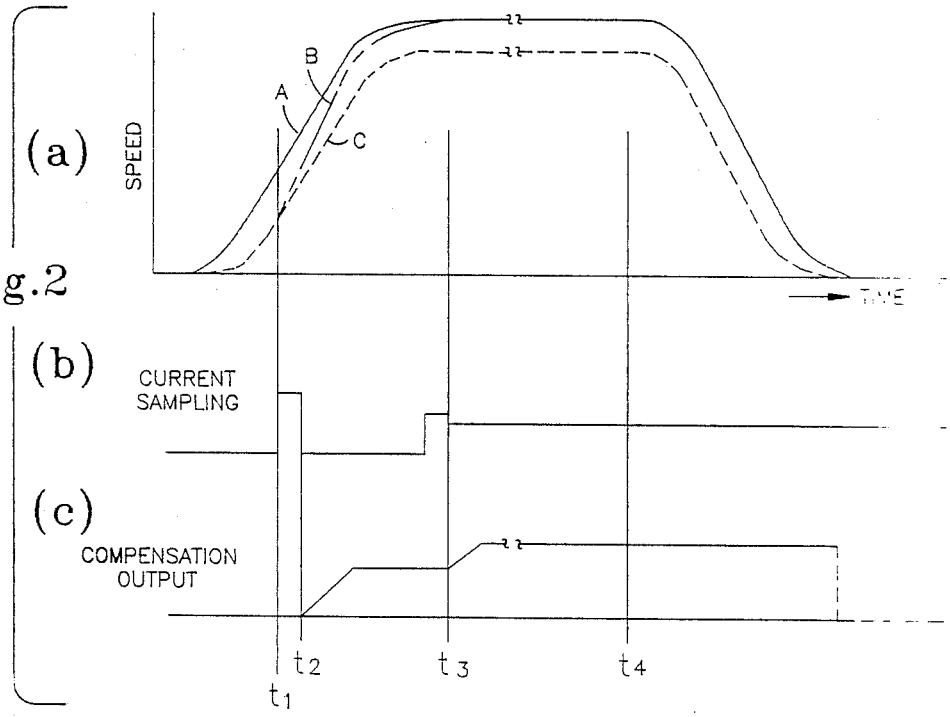
FIG. 2 is a wave diagram of important characteristics and signals of FIG. 1.

For deceleration with the same speed curve, control is required to make the actual speed identical to the speed pattern, and therefore the control device 6 performs the increased control with the slip S as shown in FIG. 2.

In FIG. 2(*a*), the control device 6 starts acceleration with the control of the inverter frequency f and the voltage according to the acceleration pattern of designated speed A as speed command, and the slip operation circuit 7 performs sampling of the direct current $I_{DC}$ during the time from t1, which is a predetermined position during acceleration to t2. This sampling period corresponds to a speed range in which movement is relatively stable and repeated detection error is at minimum. It is shown in FIG. 2(*b*). The motor output torque $T_M$ is calculated by the slip frequency (S) signal on line 7*c* of FIG. 1 from the slip operation circuit, and the load torque $T_L$ is computed from the output torque by equation (2). Then, the frequency $F_M$ and voltage $V_M$ required for the load torque $T_L$ are calculated by the equations (3) and (4), and the inverter control is performed with the frequency $F_M$ and voltage $V_M$.

Owing to such a control, the gap between the speed pattern A and the actual speed B shown in FIG. 2(*a*) is compensated during acceleration, thereby bringing the actual speed B close to the speed pattern A. In this compensation, a sharp change of torque is prevented by reaching the designated compensation with a gradual increase of constant rate as indicated by compensation output in FIG. 2(*c*). In FIG. 2(*a*), the curve C indicates speed changes with no compensation.

For movement after the completion of acceleration, the sampling of the direct current $I_{DC}$ is performed again and ended at a time $t_3$ as shown in FIG. 2(*b*), and the motor torque $T_M$ and the load torque $T_L$ are computed from this current $I_{DC}$ as in the case of acceleration, performing the compensation control compensating the error between the designated pattern A and the actual speed B. This compensation control is again conducted gradually at a constant rate as shown just after time $t_3$ in FIG. 2(*b*). The compensation during the constant speed movement makes it possible to amend an over or under compensation due to the possible influence of other factors during the acceleration.

When the elevator reaches the deceleration start point at time $t_4$, the inverter control is performed with the frequency $F_M$ and the voltage $V_M$ by adding the slip S corresponding to the load torque $T_L$ calculated during the acceleration and the constant speed movement and the impedance voltage $V_Z$ to the voltage/frequency based on the speed pattern A, and then frequency $F_M$ and the voltage V, so that the deceleration indicated by the speed pattern A is realized and a stop at the desired position is also realized.

As appreciated from the above description, the detection of the load torque and the compensation are done smoothly and almost finished during the acceleration, reducing any excessive disturbance to the passengers during the constant speed run. Furthermore, in precisely realizing the pattern during the constant speed movement, the amount of the correction is gradual and small, reducing the time therefor. Any disturbance is minimal even for short distance traveling. In addition, because of the open-loop character of the control system, relatively stable control is attained compared with a feed-back system in which a resonance may occur with the mechanical system, deteriorating the comfortableness of the elevator ride.

In the control described above, it is permissible to compute the slip S from the patterned data. And, in the deceleration control, by amending the value corresponding to the load torque $T_L$ based on the speed change, the deceleration curve can be made to have less gap with the speed pattern. Moreover, the load sampling $T_3$ is not limited to once, and for instance a mean amendment after continuous detections are satisfactory.

Although the invention has been shown and described with respect to an exemplary embodiment thereof, it should be understood that the foregoing and other changes, omissions and additions may be made therein and thereto, without departing from the spirit and scope of the invention.

We claim:

1. A speed control system for an elevator employing an induction motor driven by an inverter, characterized in that it comprises a slip operation circuit, responsive to a sensed DC signal having a magnitude indicative of DC power input to the inverter, for providing a slip frequency signal; and a control device, responsive to a dictated speed profile signal and to said slip frequency signal, for determining output torque and load torque of the motor from said slip frequency and for determining the actual rotating speed of the motor from said torque determinations for providing inverter frequency and voltage control signals so as to make the actual speed identical to that dictated by said dictated speed profile signal.

2. The system of claim 1, wherein said slip frequency signal is sampled during the acceleration and the constant speed movement.

3. The system of claim 2, wherein at a selected deceleration starting position, the control device provides inverter frequency and voltage control signals for making the actual speed pattern identical to the speed dictated by said speed profile signal by control of the slip frequency according to said load torque determined during said constant speed movement.

* * * * *

UNITED STATES PATENT AND TRADEMARK OFFICE

CERTIFICATE OF CORRECTION

PATENT NO. : 4,982,816

DATED : January 8, 1991

INVENTOR(S) : Kazuhiko Doi et al.

It is certified that error appears in the above-identified patent and that said Letters Patent is hereby corrected as shown below:

| Column No. | Line No. | |
|---|---|---|
| 2 | 1 | Cancel "addition" and insert --additional-- |
| 2 | 60 | Cancel "a the" and insert --the-- |
| 3 | 6 | Cancel the comma after "although" |
| 3 | 7 | Cancel "is" and insert --are-- |
| 3 | 11 | Cancel "valued" and insert --values-- |
| 3 | 14 | Cancel "computers" and insert --computes-- |
| 4 | 33 | Cancel "voltage V" and insert --voltage $V_M$-- |
| 4 | 58 | Cancel "are" and insert --is-- |

Signed and Sealed this

Twenty-fifth Day of May, 1993

*Attest:*

Michael K. Kirk

MICHAEL K. KIRK

*Attesting Officer*

*Acting Commissioner of Patents and Trademarks*